United States Patent [19]

Littrell

[11] Patent Number: 4,993,970

[45] Date of Patent: Feb. 19, 1991

[54] MULTIPLE FUNCTION ELECTRICAL OUTLET AND ELECTRICAL DISTRIBUTION SYSTEM UTILIZING THE SAME

[76] Inventor: Gary L. Littrell, 302 Timbercrest Ct., Schaumburg, Ill. 60193

[21] Appl. No.: 402,488

[22] Filed: Sep. 1, 1989

[51] Int. Cl.[5] ..... H01R 13/60

[52] U.S. Cl. ..... 439/535; 174/48; 439/540

[58] Field of Search ..... 174/48; 439/535, 538, 439/540, 542, 543

[56] References Cited

U.S. PATENT DOCUMENTS 2,968,689 1/1961 Johnson ..... 174/48

*Primary Examiner*—Eugene F. Desmond

*Attorney, Agent, or Firm*—Charles F. Meroni, Jr.

[57] ABSTRACT

In combination, a multiple function electrical outlet and electrical distribution device for attachment to a floor and electrical duplex receptacles and jacks comprising a plate-like base and a plate-like floor fitting. The plate-like base and the plate-like fitting are shaped in such a way that the plate-like fitting is pivotally movable into and out of nested superimposed engagement with the plate-like base. The plate-like base has an enlarged base opening for receipt of electrical circuit lines therethrough. The plate-like floor fitting has an elongated centrally located fitting opening vertically aligned with the base opening. The fitting opening is peripherally bounded by a U-shaped upright fitting wall dividing the plate-like floor fitting into a central compartment and a peripheral compartment located at the outside perimeter of the U-shaped upright fitting wall. Upright receptacle support posts are positioned at spaced intervals in the peripheral compartment. Chase nipples secure the plate-like base to a floor. Electrical duplex receptacles are attached to the receptacle support posts and are positioned in the peripheral compartment and are isolated from said central compartment by the U-shaped upright fitting wall. A jack holder plate is mounted on the U-shaped upright fitting wall. Jacks are secured in the jack openings in the jack holder plate. A dish-shaped cover provides access to the receptacles and jacks.

20 Claims, 8 Drawing Sheets

MULTIPLE FUNCTION ELECTRICAL OUTLET AND ELECTRICAL DISTRIBUTION SYSTEM UTILIZING THE SAME

BACKGROUND OF THE INVENTION

This invention relates generally to floor duct apparatus useful for the housing and routing of power and signaling lines, and cables generally installed during construction of floors and floor elevations of multi storied office buildings. More particularly, the invention relates to improved multiple functioning electrical outlet and distribution devices.

In the past there have been a variety of different electrical outlets and distribution systems that have been used for electrically connecting various types of office equipment thereto. Typical systems have included floor level mounted receptacles where the electrical receptacles are mounted in boxes that are recessed in the floor. Other types of systems that have been used involve boxes having electrical receptacles mounted in them where the boxes are mounted on top of the floor or in the wall so that various types of electrical appliances commonly used in an office can be connected including typewriters, lamps, clocks and whatever. In more recent times, an effort has been made to develop more orderly electrical outlets so that a single station of outlets can be put in place to service a series of office work stations and all of the appliances and equipment that might need to be electrically connected to a power source. It is to this subject that my invention is addressed, and my invention particularly concerns a group of multiple function electrical outlet and distribution devices of new and improved types.

My devices are provided with high and low density compartments that are walled separately from one another. The walls and dividers for the high and low density compartments can be readily changed and notches can be provided in a U-shaped upright fitting wall to enable positions of high and low density compartments to be varied.

Still further, and importantly my plate-like base and plate-like floor fitting are hinged together and attachable by Chase nipples to a floor and electrical conduits at floor level in such a new and unique way that the base and the fitting can be flat wire engaged with hex heads on the Chase nipples being located between base and fitting without interference so they can be flat wise engaged on top of one another.

SUMMARY OF INVENTION

In combination, a multiple function electrical outlet and electrical distribution device and electrical duplex receptacles and jacks, the improvement comprising a plate-like base, a plate-like floor fitting, the plate-like fitting having pivot means pivotally connecting the plate-like floor fitting to the plate-like base, the plate-like base and the plate-like fitting being shaped in such a way that the plate-like fitting is pivotally movable into and out of nested superimposed engagement with the plate-like base, the plate-like base having an enlarged base opening for receipt of electrical circuit lines there through, the plate-like floor fitting having an elongated centrally located fitting opening vertically aligned with the base opening, the fitting opening being peripherally bounded by a U-shaped upright fitting wall dividing the plate-like floor fitting into a central compartment and a peripheral compartment located at the outside perimeter of the U-shaped upright fitting wall, upright receptacle support posts positioned at spaced intervals in the peripheral compartment, the electrical duplex receptacles are attached to the receptacle support posts and are positioned in the peripheral compartment and are isolated from the central compartment by the U-shaped upright fitting wall, a jack holder plate mounted on the U-shaped upright fitting wall, means securing the jack holder plate to the U-shaped upright fitting wall, the jack holder plate having longitudinally spaced jack openings for receipt of jacks, the jacks are secured in the jack openings in the jack holder plate, and a dish-shaped floor fitting cover telescopingly mounted over the plate-like base and the plate-like floor fitting for protectively encasing and shielding the same, the dish-shaped cover having a series of cover openings aligned with the duplex receptacles and the jacks when mounted over the plate-like fitting thus exposing them exteriorally of the floor fitting cover for ready access thereto.

Yet other features of my invention concern the U-shaped upright fitting wall and the plate-like base being recessed at bottom ends to provide spaced parallel recessed areas of sufficient size for receiving upper ends of electrical conduits.

Yet other features concern the plate-like base and the fitting having upright flanges extending transversely into said centrally located opening defined by the U-shaped upright fitting walls, and means for co-action with the flanges for locking them together to lockout pivotal movement of the fitting on the plate-like base.

According to other features of my invention, the jacks are provided with spring means for operatively retaining the jacks in the jack openings on the jack holder plate.

Yet other features of my invention concern the provision of lockout members operatively connected with the spring means to resist vertical displacement from the jacks from retained engagement in the jack openings on the jack holder plate.

Yet other and still further features of my invention concern the U-shaped upright fitting wall being provided with upright diverging terminal legs extending to an outer edge of the plate-like floor fitting for further isolating the central and peripheral compartments from one another, and the plate-like floor fitting for further isolating the central and peripheral compartments from one another, and said plate-like floor fitting having an upright wall positioned in spaced relationship to a bottom end of said U-shaped upright fitting wall, the plate-like base and the plate-like floor fitting having vertically aligned openings positioned between said bottom and U-shaped upright fitting wall and said upright wall, the pivot means being located at an end of the device most adjacent to the vertically aligned openings thus enabling the plate-like floor fitting to be upwardly pivoted from a plane parallel to the plate-like base through 90° or more to provide ready access to the thus exposed underlying plate-like base.

According still to further features of my invention, the plate-like base and the fitting having upright flanges extending transversely into the centrally located opening defined by the U-shaped upright fitting walls, and means for co-action with the flanges for locking them together to lockout pivotal movement of the fitting on the plate-like base.

Other and still further features of my invention concern the plate-like floor fitting being provided with plate-like floor fitting being provided with six upright posts arranged in rows of three on opposite sides of the U-shaped upright fitting wall, the six upright posts providing means for supporting the cover and also for protecting and shielding the points of attachment between the duplex receptacles and the receptacle support posts.

Further features of my invention concern a new and improved multiple function electrical outlet and distribution device having central and peripheral compartments separated by a U-shaped upright fitting wall, the wall having notches, wall means extending outwardly at opposite sides of the U-shaped upright fitting wall further dividing the aforesaid compartments into high tension and low tension compartments.

Other features of my invention include a multiple function electrical outlet and electrical distribution device for attachment to a floor, the improvement comprising a plate-like base, a plate-like floor fitting, the said plate-like fitting having pivot means pivotally connecting said plate-like floor fitting to said plate-like base, the plate-like base and the plate-like fitting being shaped in such a way that the plate-like fitting is pivotally movable into and out of nested superimposed engagement with said plate-like base, the plate-like base having an enlarged base opening for receipt of electrical circuit lines there through, the plate-like floor fitting having an elongated centrally located fitting opening vertically aligned with said base opening, the fitting opening being peripherally bounded by a U-shaped upright fitting wall dividing the plate-like floor fitting into a central compartment and a peripheral compartment located at the outside perimeter of the U-shaped upright fitting wall, upright receptacle support posts positioned at spaced intervals in said peripheral compartment on which electrical units can be installed, and notch means in said floor fitting for accommodating heads of Chase nipples providing clearance for Chase nipples thus allowing said floor fitting to lie flat-wise upon said plate-like base.

BRIEF DESCRIPTION OF THE DRAWINGS

Other objects and features of the present invention will become more fully apparent in view of the following detailed description taken in conjunction with the accompanying drawings illustrating several preferred embodiments, as follows.

DESCRIPTION OF THE PREFERRED EMBODIMENTS

Figure 1:
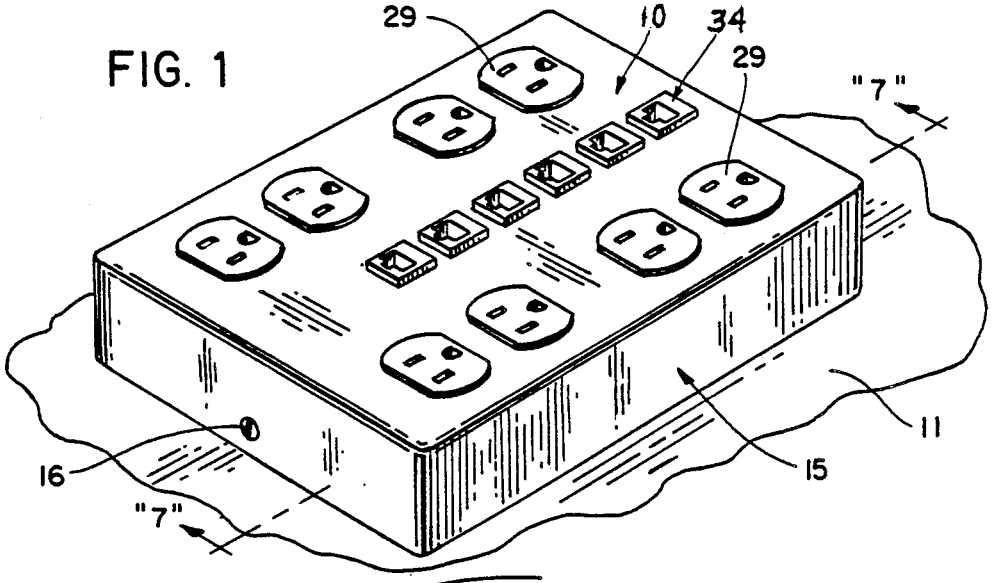
FIG. 1 is a fragmentary perspective view of a multiple function electrical outlet and electrical distribution device.

The reference numeral 10 indicates generally my multiple function electrical outlet and distribution device. The device 10 is adapted to be mounted on a floor surface 11 and suitable connectors can be utilized, for attaching the device in place on the floor and several embodiments are illustrated and discussed hereafter.

The distribution device 10 further includes a plate-like base 12 and a plate-like floor fitting 13. The base 12 and the floor fitting 13 are secured in pivotal assembly together and the pivots or pivot pins are shown at 14,14 which are located on opposite sides of the device 10, as shown in FIGS. 3 and 4.

Figure 2:
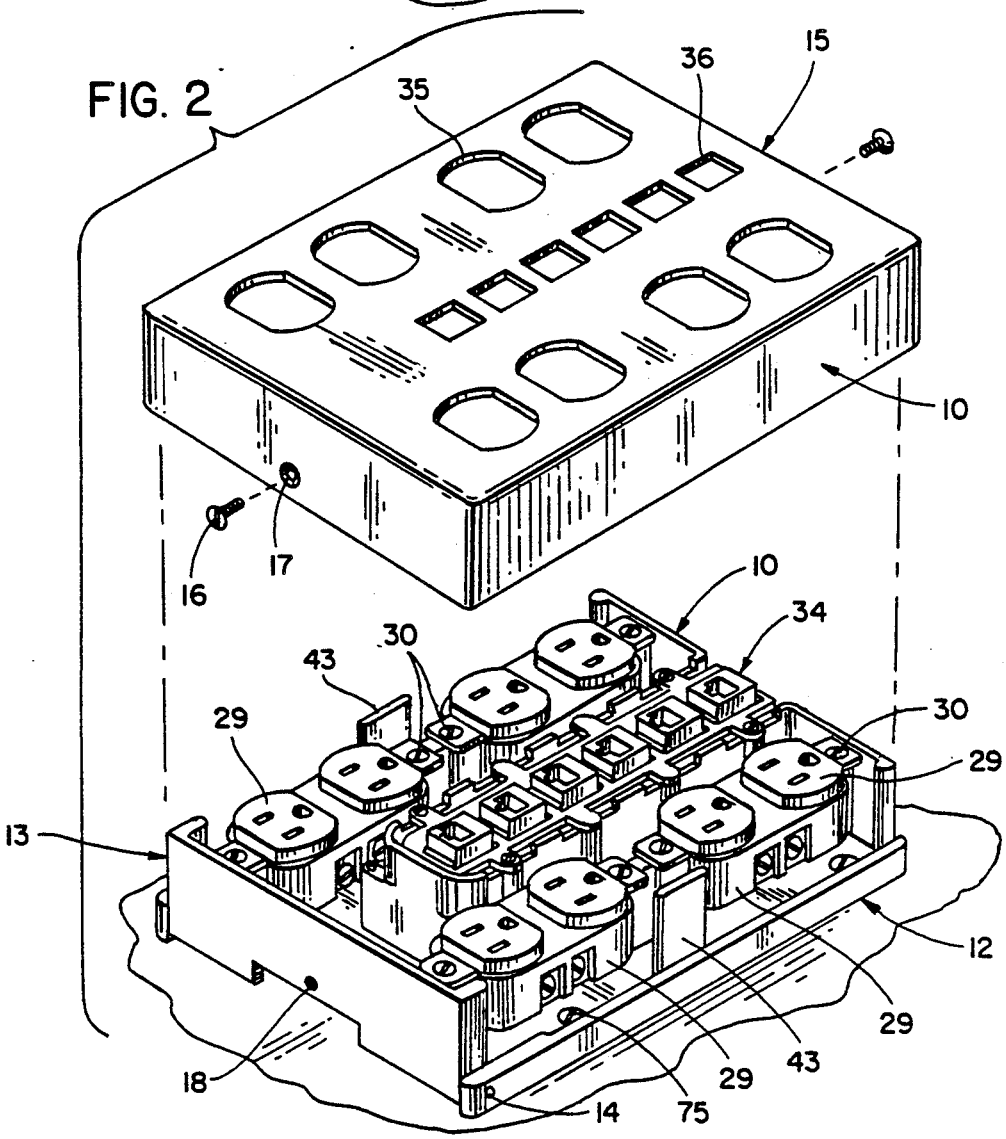
FIG. 2 is an exploded view illustrating components of the device shown in FIG. 1.

A cover is further included as indicated at 15 in FIGS. 1, 2, and 5*a*. The cover 15 is provided with screws 16 which extend through holes 17 in the cover, and are joined with screw hole 18 in the fitting 13 so that the components of my device can be secured in fixed unitary relation as shown in FIG. 1. The cover 15 can be readily removed from the floor fitting 13 by detaching the screws 16 so that access can be obtained to the base 12 and the fitting 13 when necessary.

Figure 3:
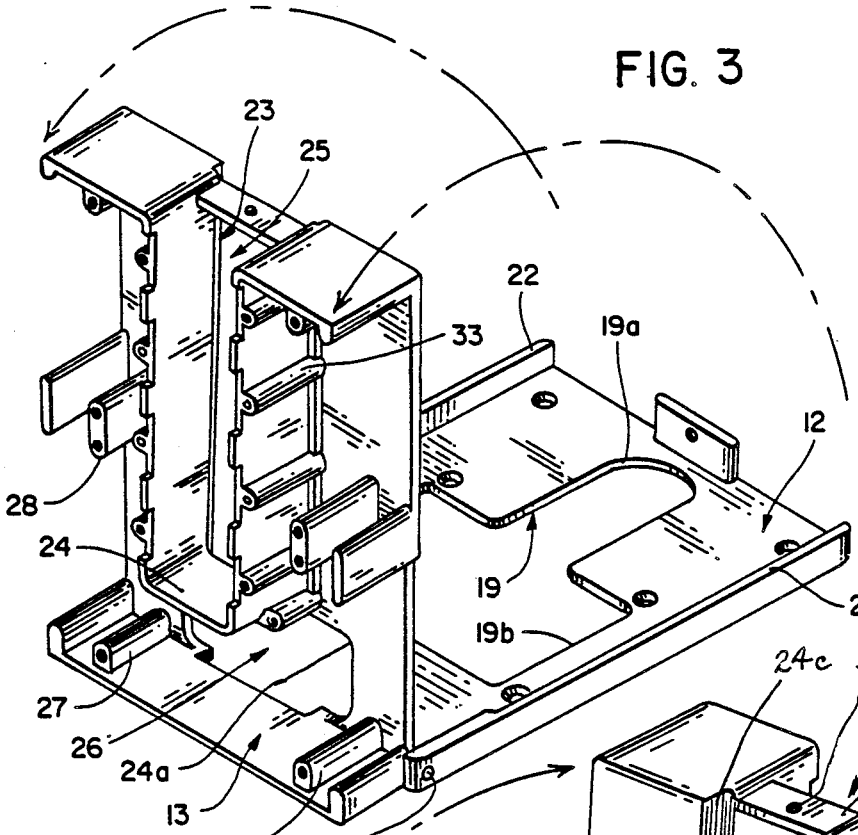
FIG. 3 is a perspective view showing a plate-like base in pivotal assembly with a plate-like floor fitting.
Figure 4:
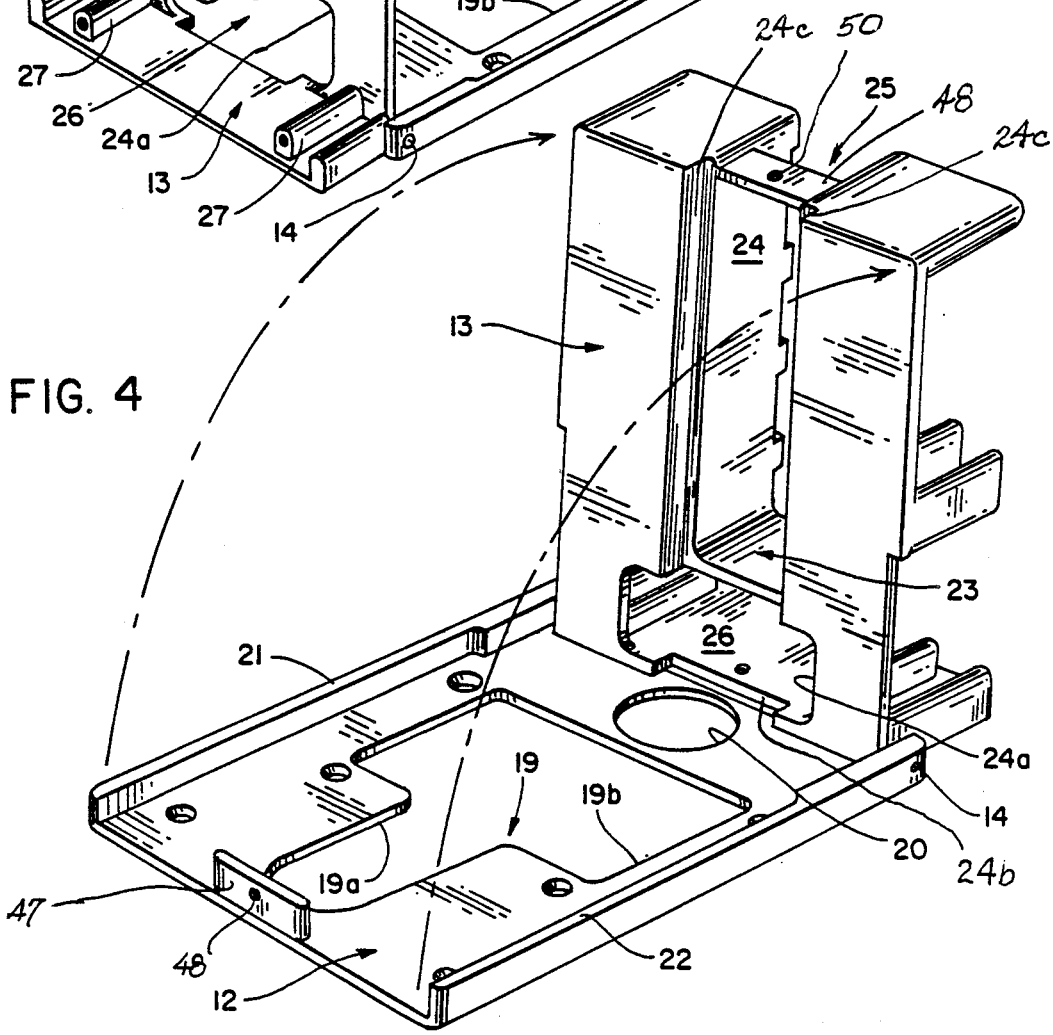
FIG. 4 is an enlarged perspective view of the bace and floor fitting shown in FIG. 3 only as viewed from an opposite corner and showing the way that the components can be pivoted into different relationships relative to one another.

The plate-like base 12 and the plate-like fitting 13 are shaped in such a way that the plate-like fitting is pivotally movable into and out of nested super-imposed engagement with the plate-like base as shown in FIGS. 2, 3 and 4. It will further be noted that the plate-like base 12 has an enlarged base opening 19 for receipt of electric circuit lines there through.

The plate-like base 12 and the plate-like floor fitting 13 are shaped in such a way that the plate-like fitting 13 is pivotally moveable into and out of nested superimposed engagement with the plate-like base 12 on the pivots or pivot pins 14 as shown in FIGS. 3 and 4. The base 12, the fitting 13 and the cover are castings preferably made from aluminum.

The plate-like base 12 has an enlarged base opening 19 (FIG. 3) which includes a U-shaped neck portion 19*a* (FIG. 4). According to important features of my invention, the U-shaped neck portion 19*a* provides an area where a Chase nipple 71 can be secured as will be later described in connection with the description of FIG. 6.

A second Chase nipple 70 is engageable in opening 20. The opening 19 further includes a larger rectangularly shaped edge portion 19*b* defining a generally rectangular part of the opening 19. The opening 19 is particularly configurated as in proximity to electrical circuit lines when the distribution device is mounted in an installed position. Also provided in the plate-like base 12 is a second circular opening 20 which is located centrally of the opposite upwardly turned upright base edges 21 and 22. The circular opening 20 is located at an end of the plate-like base 12 most closely positioned to the pivots or pivot pins 14.

The plate-like floor fitting 13 has an elongated centrally located fitting opening 23 vertically alignable with the base opening 21 when the base 12 and the plate-like floor fitting are in an superimposed position as seen in FIG. 2 and in contrast to their angulated position as shown in FIGS. 3 and 4. The opening 23 is generally parallel sided or rectangular in shape and is in turn linked to another wider rectangularly shaped opening 24*a*. The fitting opening 23 is vertically aligned with the plate opening 19 in the plate-like base 12 when the base 12 and the fitting 13 are super-imposed in nested, engaged assembly together (FIG. 2). At this point in time, the opening 20 in the plate-like base 12 is in direct vertical alignment with the rectangularly shaped opening 24*a* in the fitting 13 so that wires extended through the opening 20 can also readily extend through the opening 24*a* in the fitting 13. The elongated centrally located fitting opening 23 is vertically aligned with the base opening 19 as previously stated and also, the opening 23 is peripherally bounded by a U-shaped upright fitting wall 24 which divides the plate-like floor fitting 13 into a central compartment 25 and a peripheral compartment 26 located at an outside perimeter of the U-shaped upright fitting wall 24.

Figure 6:
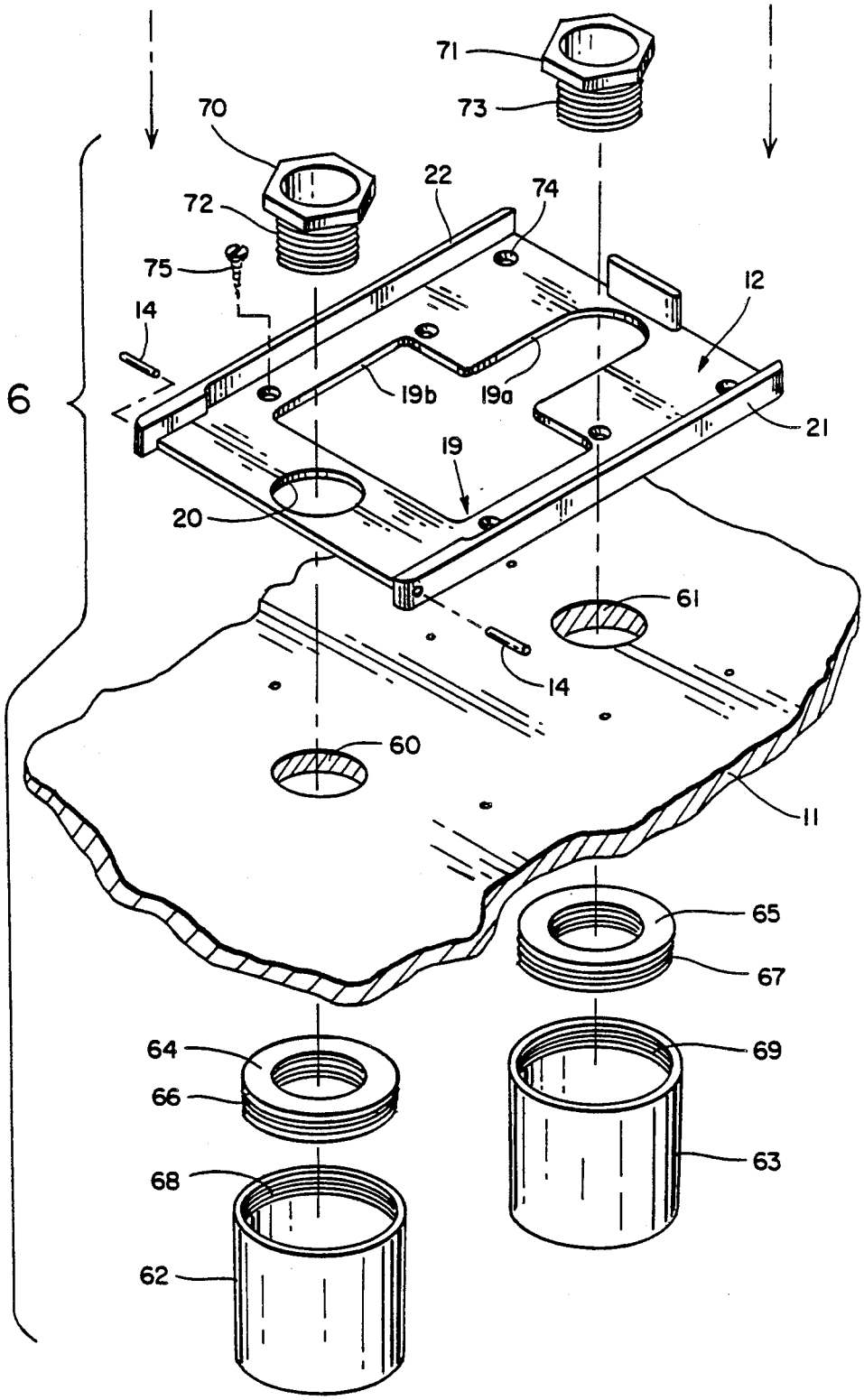
FIG. 6 is an enlarged exploded view of portions of my device shown in FIG. 1, and illustrating the way in which the device can be anchored to a floor.
Figure 7:
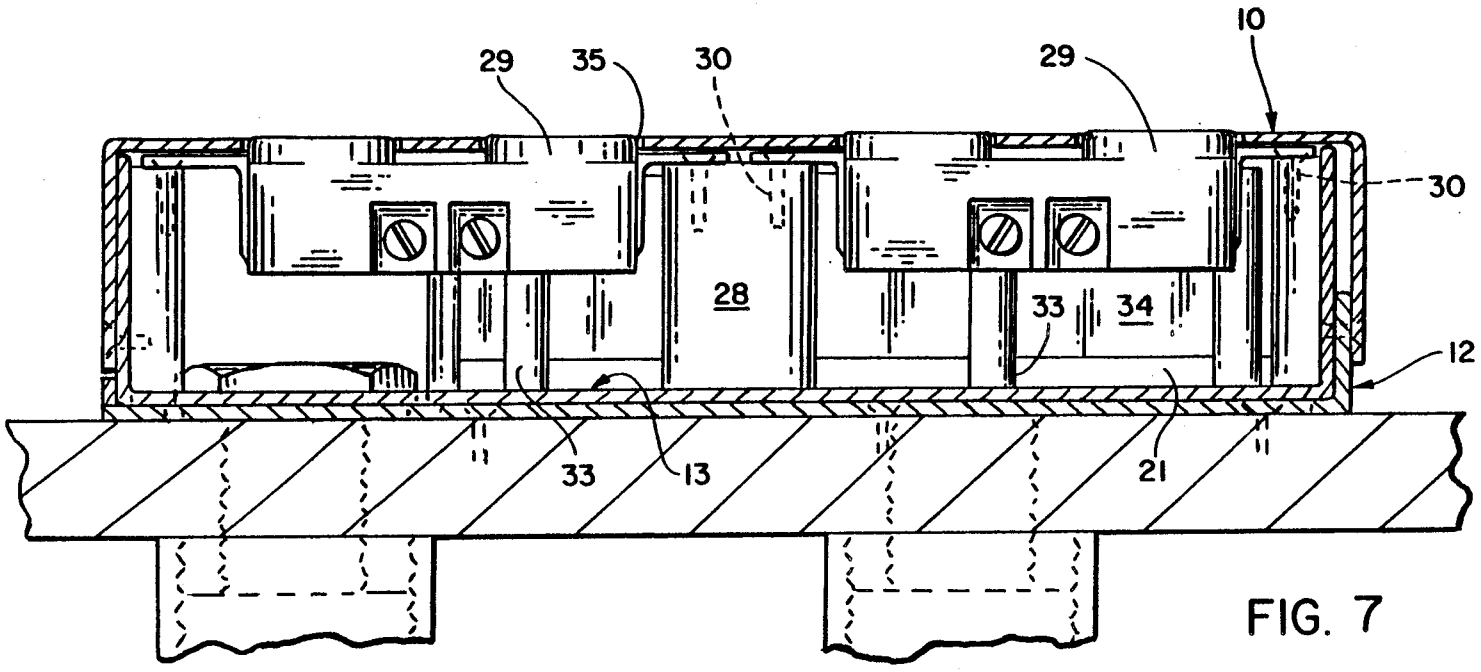
FIG. 7 is an enlarged vertical section showing my multiple function electrical outlet and electrical distribution device in assembly with a floor structure.

According to other features of my invention, the U-shaped upright fitting wall is provided with a downwardly opening notch 24*b* in the rear compartment 26 that is adapted to co-act with the opening 20 so that when the Chase nipple is positioned to secure the base plate 12 at a desired location as shown in FIG. 6, the notch provides clearance for the nipple 70 to enable the plate-like floor fitting to freely move into its parallel position with the base plate 12. According to still further features of my invention, the U-shaped upright fitting wall 24 has notched areas 24*c* and 24*d* opening downwardly and extending the length of the legs of the U of the fitting wall to provide clearance for the Chase nipples 70 and 71, when the nipples 70 and 71 are assembled in place as shown in FIG. 6. Without these notches 24*b*, 24*c* and 24*d*, the hex heads of the Chase nipples would interfere and prevent the plate-like floor fitting from lying in flush fully engaged bottomed engagement against the plate-like base 12 when the base 12 and the floor fitting 13 are in the position shown in FIG. 2.

The device 10 is further provided with upright receptacle support posts 27 and 28 which are of different types as will be further described at another point herein. These posts 27 and 28 are positioned at spaced intervals on the fitting 13 in the peripheral compartment 26. A plurality of electrical duplex receptacles or socket units 29 each having a pair of lugs 29*a* at opposite ends of each receptacle. The lugs 29*a* are attached by screws 30 to the receptacle support posts 27 and 28.

Figure 5:
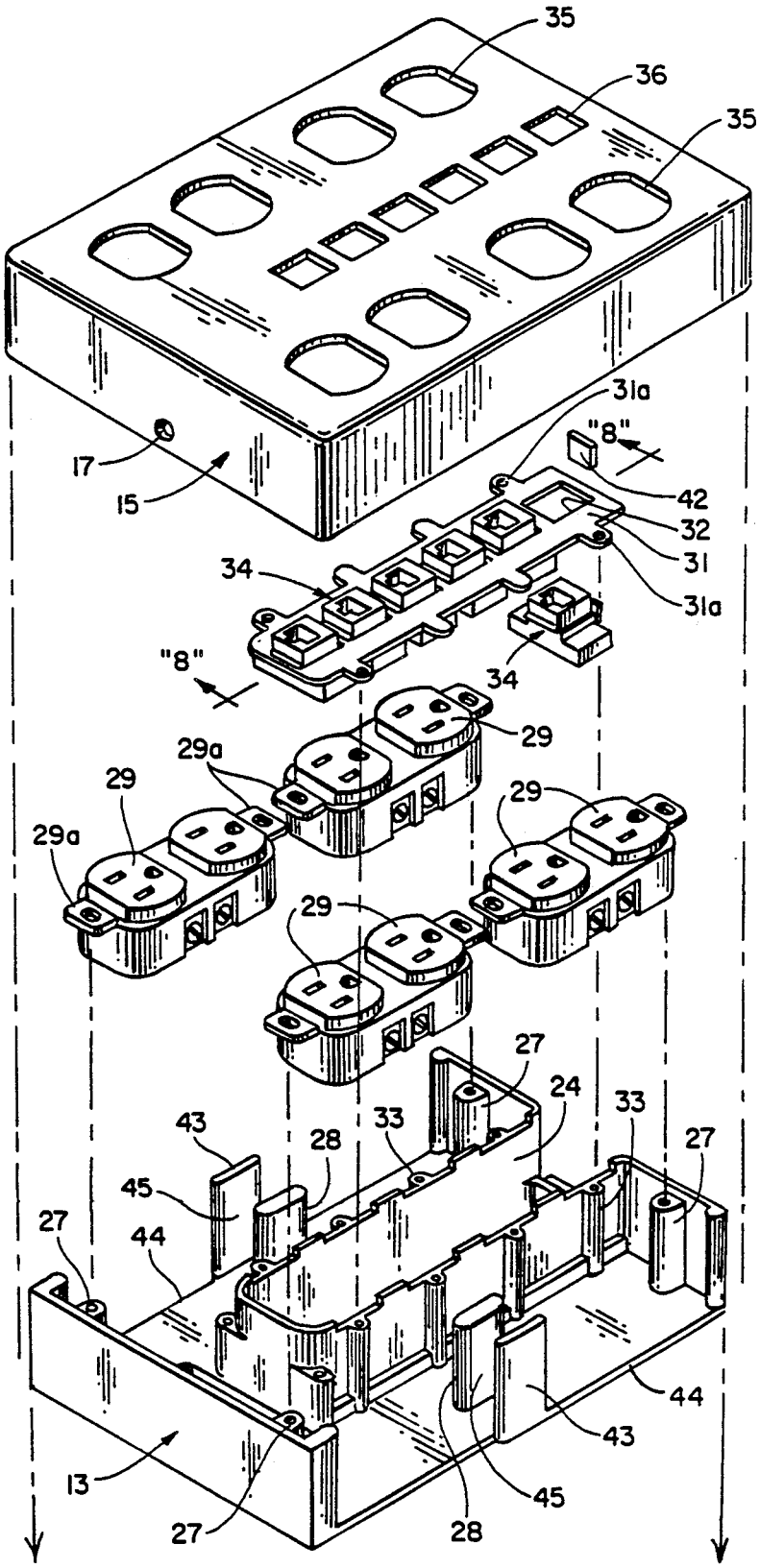
FIG. 5 is an enlarged exploded view of my multiple function electrical outlet and electrical distribution device shown in FIG. 1.

The device 10 further includes a jack holder plate 31 (FIG. 5) that is mounted on the U-shaped upright fitting wall 24. The jack holder plate 31 has a series of lugs 31*a* extending in rows at opposite margins of the plate 31. In addition, the plate 31 has a series of longitudinally spaced jack openings 32 (FIG. 5). The jack holder plate 31 is mounted on posts 33 which are formed integral with the U-shaped upright fitting wall 24. These posts are arranged in rows which are spaced on opposite sides above the fitting wall 24. Jacks or socket units 34 are provided for telescoped engagement in the longitudinally spaced jack openings 32. The jacks are secured in the jack openings 32 in the jack holder plate 31.

When the components of my device 10 are assembled, the dish-shaped floor fitting cover 15 is telescopingly mounted over the plate-like base 12 and the plate-like floor fitting 13 for protectively encasing and shielding the wiring as well as the electrical duplex receptacles 29 and the jacks 34. As will be apparent from FIGS. 1, 2 and 5, it will be seen that the dish-shaped cover 15 has a series of different sized cover openings 35 and 36 which are aligned with the duplex receptacles 29 and the jacks 34 when mounted over the plate-like fitting 13 thus exposing them exteriorly of the floor fitting cover for readily access thereto so that plugs from different types of machines can be electrically connected to the duplex receptacles 29 and the jacks 34 in a manner well known in this art.

Figure 8:
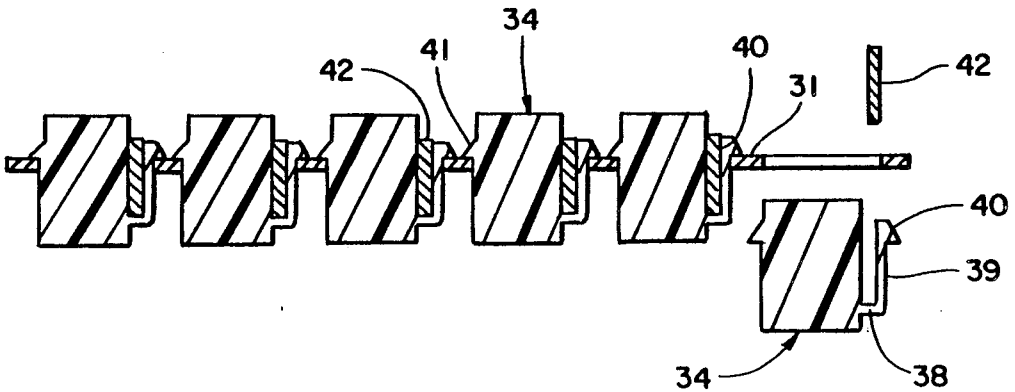
FIG. 8 is an enlarged vertical cross sectional view taken on a line 8—8 looking in the direction indicated by the arrows as seen in FIG. 5.

From a further study of FIG. 8 it will be seen that the jacks 34 each are provided with an L-shaped spring clip 37 formed integral with the jack. The clip has a base clip blade 38 and an upright clip leg 39. The clips 37 further include an offset clip retainer shoulder 40 which is adapted to engage a top side of the jack holder plate 31 when the components are in assembled relation as shown in FIG. 8. To further balance the jack 34 on the jack holder plate 31, the jacks are each provided with a second offset retainer shoulder 41 on an opposite side of the jack 34 so that opposite sides of the jack can be supported on the plate 31 in a secure assembled relationship. In order to prevent the clip 37 from collapsing when subjected top side forces, lockout members 42 as seen in FIG. 8. The lockout member 42 is sized to fit into the opening between the jack 34 and the upright clip leg 39 so that it can rest upon the base clip leg 38 when the components are assembled as seen in FIG. 8. Thus, when the lockout member 42 is in the gap between the jack 34 and the clip 37, it is firmly in place and prevents the upright clip 39 from moving in a direction towards the jack 34. It will further be appreciated that each clip and the shoulder 41 are formed integral with the same material as the jack as a one piece unit.

Figure 10:
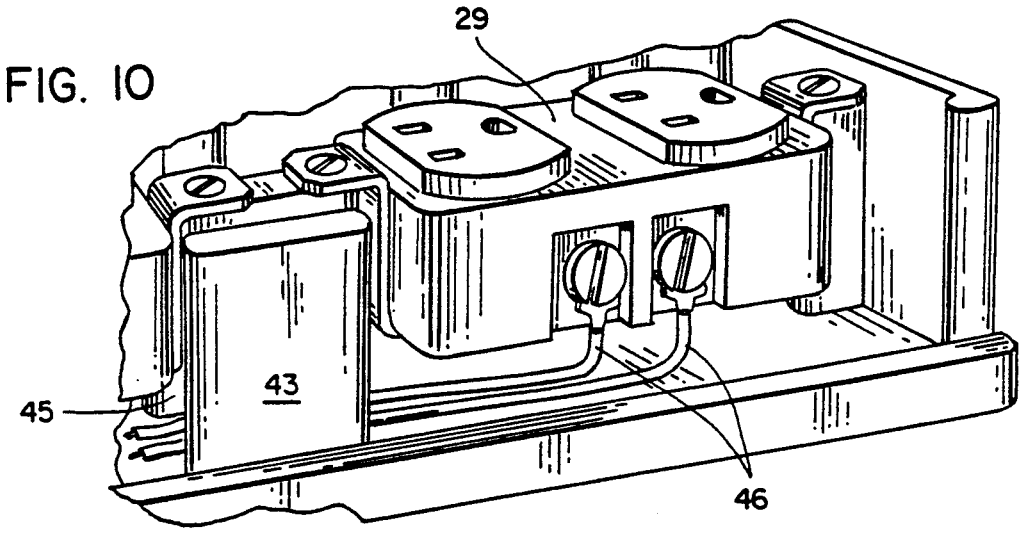
FIG. 10 is an enlarged fragmentary view of certain components of my multiple function electrical outlet and electrical distribution device showing the way in which the fittings can be wired.

According to certain features of my invention, the base 13 is provided with a pair of upright lugs 43,43 at opposite edges 44,44 thereof. These lugs 43 are positioned in spaced relationship to upright receptacle support posts 28,28 providing a wire channel 45,45 positioned between upright posts or lugs 28,28 and 43,43. Thus, when the electrical duplex receptacles are mounted in place on the posts 27 and 28, electrical leads 46,46 from each of the receptacles can be maintained within the confines of the base 12 and the fitting 13 to control the wires and prevent them from being pinched and alike as seen in FIG. 10.

The base 12 and the floor fitting 13 can be locked together in assembly. To this end, the plate-like base 12 has an upstanding locked tab 47 with a threaded opening 48 for co-action with a lock web 49 which joins opposite legs of the U-shaped upright fitting wall 24 together. The lock web 49 has a threaded hole 50. The hoes 48 and 50 fall into axial alignment when the floor fitting 13 is pivoted on its pivots 14 to cause the bottom of the plate-like base 12 to be engaged in flat-wise relation with the underlying plate-like base 12. Then when the screws 16 are extended into place as shown in FIG. 1, these screws also thread into the holes 48 and 50 to not only provide an anchor for the cover on the base 12 and fitting 13 but also the screws serve to connect the base and fitting 12 and 13 in locked relation to one another. The arcuate arrows in FIGS. 3 and 4 show the way in which the plate-like base 12 and the floor fitting are pivoted relative to one another on pivots 14.

In FIG. 6, I have shown another way of securing my new and improved plate-like base 12 to a floor 11. In this embodiment, the base 12 has its openings 19 and 20 aligned with floor openings 60 and 61. These floor openings 60 and 61 can be drilled through the floor by any suitable way. Conduit members 62 and 63 are aligned with the floor openings 60 and 61 along with threaded rings 64 and 65. The rings 64 and 65 have outside threads 66 and 67 which co-act with inside threads 68 and 69 on the conduit member 62 and 63 so that when they are assembled the rings 64 and 65 are threadingly retained with the conduit member 62 and 63. Cooperable with the conduit members 62 and 63 and the rings 64 and 65 are a pair of hex-headed bushings 70 and 71. The bushings 70 and 71 have tubular threaded nipples 72 and 73 which are adapted to extend through the openings 19 and 20 in the fitting 12 and also through the floor openings 60 and 61 so that the bushings 70 and 71 can be turned into threaded assembly with the ring 64 and 65 all as shown in the exploded view in FIG. 6.

As an added means to secure the base 12 to the floor 11, the base 12 is provided with a series of beveled holes 74 and screws 75 are adapted to be turned through the holes into the floor 11 as also illustrated in FIG. 6.

Figure 9:
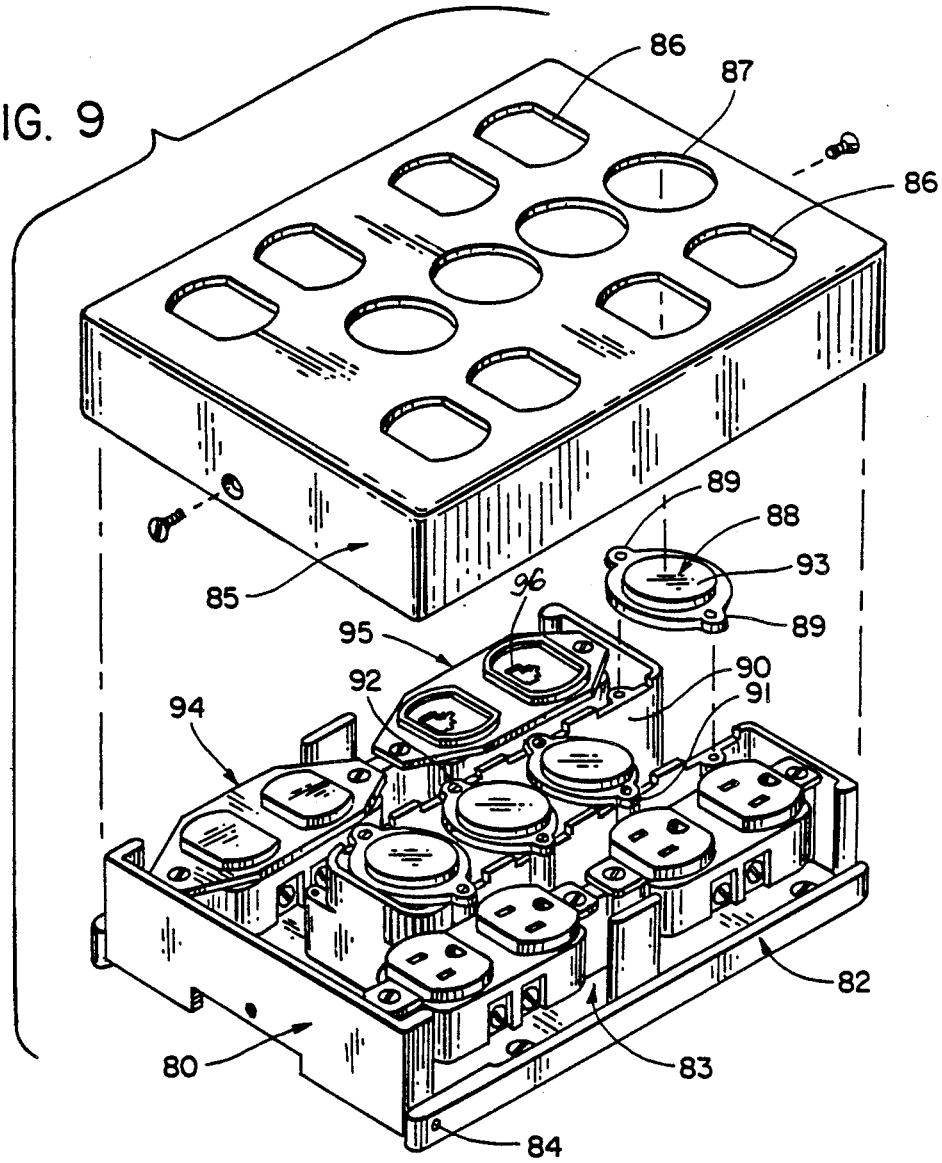
FIG. 9 is an enlarged exploded view of a modified type of multiple function electrical outlet and electrical distribution device embodying modified features of my invention.

Shown in FIG. 9 is a modified type of a distribution device 80. In this device, it includes a plate-like base 82, a plate-like floor fitting 83, which are secured together by pivots or pivot pins 84 in the same way as previously described. Mountable upon the base 82 and the floor fitting 83 is a cover 85. The cover has a different arrangement of openings on its top surface. The cover is provided with openings 86 which are similar to the openings 35 on the cover 15. The cover 86 is further provided with a series of round openings 87 rather than jack openings 36 which are arranged in a row between the rows of openings 86—86. The openings 87 are each rounded shape and are particularly configurated to co-act with cover hole plugs on bushing or fillers 88. The fillers 88 each have lugs 89,89 at opposite ends which are secured to a U-shaped upright fitting wall 90 which is similar to the fitting wall 24 that was previously described. The fitting wall 90 has a series of reinforcing posts 91. The lugs 89,89 are secured to the posts 91,91 by suitable fasteners such as screws 92. Each of the bushings has an enlarged center section 93 which is secured to a U-shaped upright fitting wall 90 that is similar to the fitting wall 24 that was previously described. It will be seen that the raised portion 93 of the bushing 88 is particularly configurated so that its perimeter will snugly fit with the edge defining opening 87 in the cover 85. By providing bushings of this type adapted to co-act with openings 87 in the cover 85, the holes in the cover 85, when unused, can be plugged to prevent dust and sediment from falling into the opening and also the bushings or cover hole fillers 88 serve to provide an attractive way to close up the openings 87 so that the appearance of the device 80 will be as attractive as possible. When it is desired to install low density components, the covers 88 can be removed and the low density components can be installed with screws securing them in place. Also, a hole can be drilled through center section 93 and electrical wires can be threaded through the thus drilled hole to make the electrical wires accessible and to hold them out-of-contact with the plate-like base 82 and out-of-contact with the base filling 83.

The distribution device 80 is also provided with another type of cover at 94 for covering a previously installed electrical duplex receptacle where the receptacle is not to be used so that the receptacle can be covered and so that the receptacle will not be viewed through the cover since the cover 94 will project through the openings 86 provided in the cover 85.

Cover 95 is of a different type usable with telephone jacks and having openings 96 in which the jacks may be inserted.

For the purpose of illustrating the versatility of my device 80, I have also shown a telephone adapter type of connection. If it is desired that telephone connections are to be hooked up to my distribution device 80, the device 80 can be used for this purpose.

Figure 11:
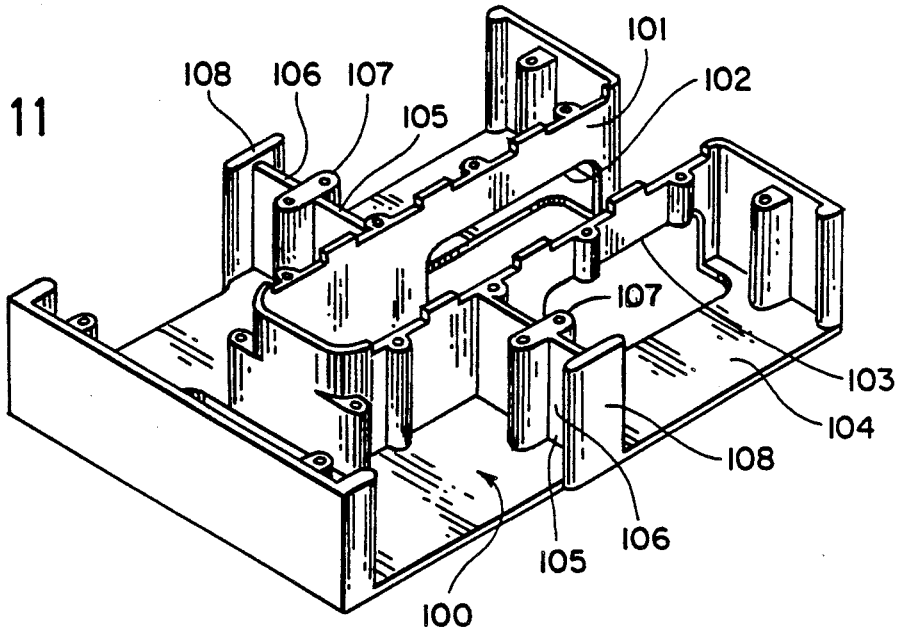
FIG. 11 is an enlarged perspective view of another modified embodiment of my plate-like floor fitting.

In FIG. 11 I have shown a modified type of a plate-like base identified at 100. The base 100 includes a U-shaped upright fitting wall 101 which is similar to the fitting wall 24 except that the fitting wall 101 has L-shaped slots or notches 102 and 103 which open up opposite opposing side wall areas of the U-shaped upright fitting wall 24. Thus, by opening up the confronting side wall areas of the U-shaped fitting wall 101 the L-shaped slots 102 and 103 confront one another at least in part. The fitting 100 also has a bottom plate portion 104 and the L-shaped slots 102 and 103 extend into the fitting bottom plate portion 104 so that each of the slots 102 and 103 open in two directions with the part of the slot extending into the plate portion 104 and another part of the slot extending into the U-shaped side wall 101.

In addition to the foregoing, the base plate 100 in FIG. 11 has divider areas which are not found on the plate-like floor fitting 13. To this end, the U-shaped upright fitting wall 101 has linking walls 105,105 extending at right angles to legs of the U-shaped fitting wall 101 as indicated at 105,105. These walls are linked to upright posts 107,107. A second pair of linking walls are indicated at 106,106 and these linking walls are connected between the posts 107 and upright lugs 108,108. In this form of my plate-like floor fitting, the wire channels 45,45 are eliminated since the linking walls or dividers 106,106 block the channels that would otherwise be provided and are provided in the plate-like floor fitting 13.

By providing dividers 106,106 in combination with the notches 102 and 103, the base identified at 11 can be used for other types of installations. Rather than have electrical duplex receptacles mounted on all of the posts in the outside horseshoe shaped compartment indicated generally at 116, new low tension compartments 117 and 118 are provided so that low tension type jacks and other low tension type fittings (not shown) can be installed on the posts provided in these compartments 117,117. The wires for the jacks can be extended through the notches or L-shaped slots 102 and 103.

Figure 12:
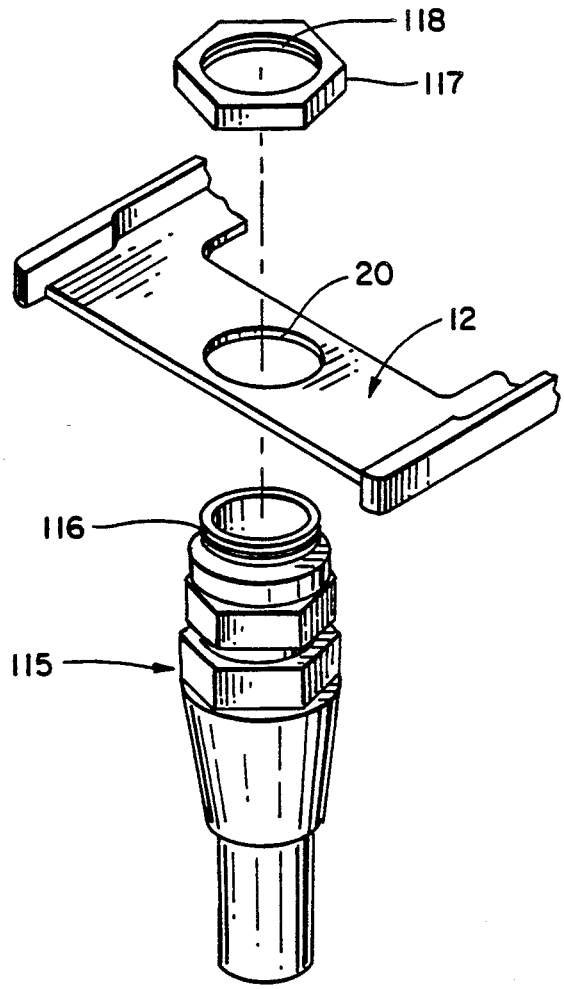
FIG. 12 is an enlarged exploded view showing another way for anchoring my multiple function electrical outlet and electrical distribution device for providing a wired connection.

In FIG. 12, I have shown a modified technique for attaching a plate-like base 12 to a conventional fire retardent heavy wall connector 115. The connector 115 includes a threaded upper end 116 where the threads are located on the outside diameter of the upper end. The threaded upper end 116 of the connector 115 is adapted to be extended through the opening 20 provided in the plate-like base 12. A hex-shaped threaded nut 117 has inside threads provided at 118. When the heavy wall connector 115 and particularly its threaded upper end is extended through the opening 20 in the plate-like base 12, then the hex-shaped nipple can be threadingly engaged with the threaded upper end 116 to secure the plate-like base in place on the heavy wall connector 115.

Figure 13:
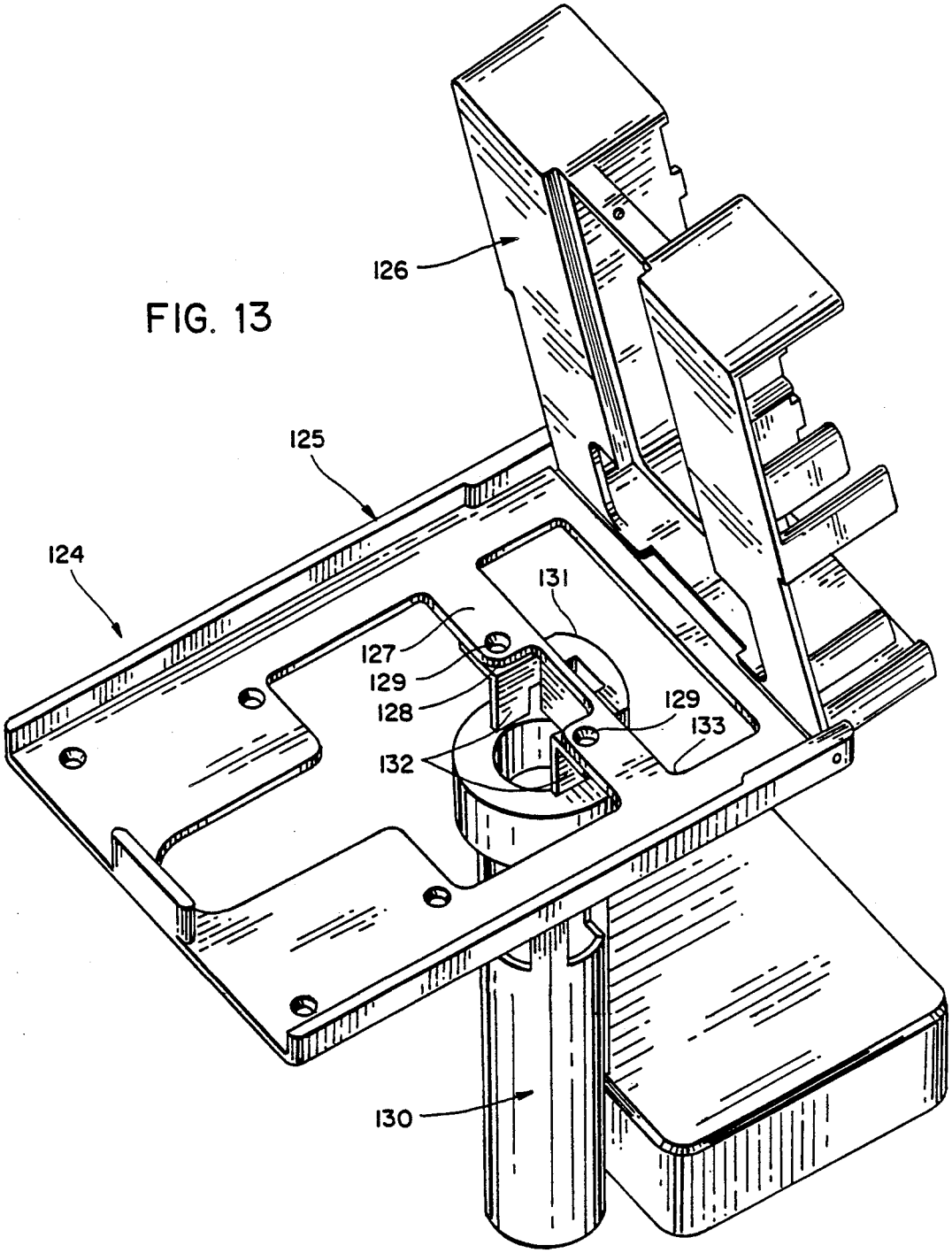
FIG. 13 is another enlarged perspective view of my multiple function electrical outlet and electrical distribution device showing a modified way of attachment to a floor support.

Shown in FIG. 13 is yet another form of my invention wherein I have disclosed a modified device 124 (a cover not being illustrated). If desired, a cover of the type shown at 15 in FIG. 1 can be used with my device 124. The device 124 includes a plate-like base 125 which is modified from the base 12 in a way that will hereafter be described. Cooperable with the plate-like base 12 is a plate-like floor fitting 126 which is very similar to the plate-like floor fitting 13. These members are pivotally secured in the same way as shown at 14 in FIGS. 3 and 4.

According to other features of my invention, the plate-like base 125 has a web 127 provided with a notched area 128 midway between opposite ends and centered on the slots provided in the plate-like base, which slots are shaped the same as the enlarged base opening shown at 19 in FIG. 1. The second slot is identified at 133 and it is of a square shape rather than of a round shape as shown at 20 in FIG. 4. The notched area 128 is provided in the web 127 of the plate-like base 12 so that a conventional poke through 130 can be attached thereto by means of screws or fasteners (not shown) which can be extended through bevel cut holes 129,129 also shown in FIG. 12. The fasteners when extended through the beveled shaped holes 129,129 can be firmly and securely attached with a bracket 31 carried on the device 130. Attached to the bracket 131 are upstanding L-shaped bracket ends 132,132. When the screws or fasteners (not shown) are extended through the beveled shape openings 129,129 it is in this way that the plate-like base 12 can be secured to the upstanding L-shaped bracket ends 132,132.

The poke through 130 is of a type that enables the device 124 to be engaged with a floor with the poke through device 130 extending through the floor. Thus, according to other features of my invention, the plate-like base 125 has been uniquely configurated for use with the poke through 130 in mounted assembly thereon.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a multiple function electrical outlet and electrical distribution device for attachment to a floor and electrical duplex receptacles and jacks, the improvement comprising a plate-like base, a plate-like floor fitting, the said plate-like fitting having pivot means pivotally connecting said plate-like floor fitting to said plate-like base, the plate-like base and the plate-like fitting being shaped in such a way that the plate-like fitting is pivotally movable into and out of nested superimposed engagement with said plate-like base, the plate-like base having an enlarged base opening for receipt of electrical circuit lines there through, the plate-like floor fitting having an elongated centrally located fitting opening vertically aligned with said base opening, the fitting opening being peripherally bounded by a U-shaped upright fitting wall dividing the plate-like floor fitting into a low tension central compartment and a peripheral high tension compartment located at the outside perimeter of the U-shaped upright fitting wall, upright receptacle support posts positioned at spaced intervals in said peripheral compartment, Chase nipples for securing said plate-like base to a floor, notch means in said floor fitting accommodating heads of said Chase nipples providing clearance for said Chase nipples thus allowing said floor fitting to lie flat-wise upon said plate-like base, said electrical duplex receptacles being attached to said receptacle support posts and being positioned in said peripheral compartment and being isolated from said central compartment by said U-shaped upright fitting, a jack holder plate mounted on said U-shaped upright fitting wall, means securing said jack holder plate to said U-shaped upright fitting wall, the jack holder plate having longitudinally spaced jack openings for receipt of jacks, said jacks being secured in said jack openings in said jack holder plate, and a dish-shaped floor fitting cover telescopingly mounted over said plate-like base and said plate-like floor fitting for protectively encasing and shielding the same, the dish-shaped cover having a series of cover openings aligned with said duplex receptacles and said jacks when mounted over said plate-like fitting thus exposing them exteriorally of the floor fitting cover for ready access thereto.

2. The combination of claim 1 further characterized by said jacks having spring means for operatively retaining said jacks in said jack openings on said jack holder plate.

3. The combination of claim 2 further characterized by lockout members operatively connected with said spring means to resist vertical displacement from said jacks from retained engagement in said jack openings on said jack holder plate.

4. The combination of claim 1 further characterized by said U-shaped upright fitting wall having upright diverging terminal legs extending to an outer edge of said plate-like floor fitting for further isolating the central and peripheral compartments from one another, and said plate-like floor fitting having an upright wall positioned in spaced relationship to a bottom end of said U-shaped upright fitting wall, the plate-like base and the plate-like floor fitting having vertically aligned openings positioned between said bottom and U-shaped upright fitting wall and said upright wall, said pivot means being located at an end of said device most adjacent to said vertically aligned openings thus enabling the plate-like floor fitting to be upwardly pivoted from a plane parallel to said plate-like base through 90° or more to provide ready access to the thus exposed underlying plate-like base.

5. The combination of claim 1 further characterized by said U-shaped upright fitting wall and said plate-like base being recessed at bottom ends to provide spaced parallel recessed areas of sufficient size for receiving upper ends of electrical conduits.

6. The combination of claim 4 further characterized by said plate-like base and said fitting having upright flanges extending transversely into said centrally located opening defined by said U-shaped upright fitting walls, and means for co-action with said flanges for locking them together to lockout pivotal movement of said fitting on said plate-like base.

7. The combination of claim 1 further characterized by said plate-like floor fitting being provided with six upright posts arranged in rows of three on opposite sides of said U-shaped upright fitting wall, said six upright posts providing means for supporting said cover and also for protecting and shielding the points of attachment between said duplex receptacles and said receptacle support posts.

8. In a multiple function electrical outlet and electrical distribution device for attachment to a floor, the improvement comprising a plate-like base, a plate-like floor fitting, the said plate-like fitting having pivot means pivotally connecting said plate-like floor fitting to said plate-like base, the plate-like base and the plate-like fitting being shaped in such a way that the plate-like fitting is pivotally movable into and out of nested superimposed engagement with said plate-like base, the plate-like base having an enlarged base opening for receipt of electrical circuit lines there through, the plate-like floor fitting having an elongated centrally located fitting opening vertically aligned with said base opening, the fitting opening being peripherally bounded by a U-shaped upright fitting wall dividing the plate-like floor fitting into a compartment and a peripheral compartment located at the outside perimeter of the U-shaped upright fitting wall, upright receptacle support posts positioned at spaced intervals in said peripheral compartment, notch means in said floor fitting for accommodating heads of Chase nipples providing clearance for Chase nipples thus allowing said floor fitting to lie flat-wise upon said plate-like base, a plurality of electrical duplex receptacles attached to said receptacle support posts, a jack holder plate mounted on said U-shaped upright fitting wall, means securing said jack holder plate to said U-shaped upright fitting wall, the jack holder plate having longitudinally spaced jack openings for receipt of jacks, jacks secured in said jack openings in said jack holder plate, and a dish-shaped floor fitting cover telescopingly mounted over said plate-like base and said plate-like floor fitting for protectively encasing and shielding the same, the dish-shaped cover having a series of cover openings aligned with said duplex receptacles and said jacks when mounted over said plate-like fitting thus exposing them exteriorally of the floor fitting cover for ready access thereto.

9. The device of claim 8 further characterized by said jacks having spring means for operatively retaining said jacks in said jack openings on said jack holder plate, lockout members operatively connected with said spring means to resist vertical displacement of said jacks from retained engagement in said jack openings on said jack holder plate.

10. The device of claim 8 further characterized by said U-shaped upright fitting wall having upright diverging terminal legs extending to an outer edge of said plate-like floor fitting for further isolating the central and peripheral compartments from one another, and said plate-like floor fitting having an upright wall positioned in spaced relationship to a bottom end of said U-shaped upright fitting wall, the plate-like base and the plate-like floor fitting having vertically aligned openings positioned between said bottom and U-shaped upright fitting wall and said upright wall, said pivot means being located at an end of said device most adjacent to said vertically aligned openings thus enabling the plate-like floor fitting to be upwardly pivoted from a plane parallel to said plate-like base through 90° or more to provide ready access to the thus exposed underlying plate-like base.

11. The device of claim 8 further characterized by said U-shaped upright fitting wall and said plate-like base being recessed at bottom ends to provide spaced parallel recessed areas of sufficient size for receiving upper ends of electrical conduits.

12. The device of claim 10 further characterized by said plate-like base and said fitting having upright flanges extending transversely into said centrally located opening defined by said U-shaped upright fitting walls, and means for co-action with said flanges for locking them together to lockout pivotal movement of said fitting on said plate-like base.

13. The device of claim 8 further characterized by said plate-like floor fitting being provided with upright posts arranged in rows on opposite sides of said U-shaped upright fitting wall, said upright posts providing means for supporting said cover and also for protecting and shielding the points of attachment between said duplex receptacles and said receptacle support posts.

14. The device of claim 8 further characterized by said U-shaped upright fitting wall being peripherally bounded by upright posts for receiving a jack holder plate in mounted assembly therewith, opposite legs of said U-shaped upright fitting wall being notched providing confronting notched areas through which wiring may be passed through said plate-like fitting and said plate-like base, and linking upright dividers mounted on said plate-like floor fitting having one end secured to one of the legs of said U-shaped upright fitting wall and with said dividers being on opposite sides of said U-shaped upright fitting wall thus expanding said central compartment and dividing said peripheral compartment enabling high density and low density units to be installed in varied arrangements on said device.

15. The device of claim 8 further characterized by said plate-like floor fitting having upright lugs mounted on opposed edges of said plate-like floor fitting in spaced relationship to said U-shaped fitting wall and with said lugs being located in said peripheral compartment said peripheral compartment being generally U-shaped in configuration, said upright lugs providing means for maintaining wires from electrical units when mounted on said device away from opposed edges of said plate-like floor fitting.

16. In a multiple function electrical outlet and electrical distribution device for attachment to a floor, the improvement comprising a plate-like base, a plate-like floor fitting, the said plate-like fitting having pivot means pivotally connecting said plate-like floor fitting to said plate-like base, the plate-like base and the plate-like fitting being shaped in such a way that the plate-like fitting is pivotally movable into and out of nested superimposed engagement with said plate-like base, the plate-like base having an enlarged base opening for receipt of electrical circuit lines there through, the plate-like floor fitting having an elongated centrally located fitting opening vertically aligned with said base opening, the fitting opening being peripherally bounded by a U-shaped upright fitting wall dividing the plate-like floor fitting into a central compartment and a peripheral compartment located at the outside perimeter of the U-shaped upright fitting wall, upright receptacle support posts positioned at spaced intervals in said peripheral compartment on which electrical units can be installed, and notch means in said floor fitting for accommodating heads of Chase nipples providing clearance for Chase nipples thus allowing said floor fitting to lie flat-wise upon said plate-like base.

17. The device of claim 16 further characterized by said plate-like floor fitting comprising a casting, and a series of posts being formed integral with said U-shaped upright fitting wall, said post being adapted to receive a jack holder plate on which jacks can be secured.

18. The device of claim 16 further characterized by said plate-like base having a pair of slots, a web separating the slots from one another, said web having a centrally located notched area, a pokethrough device aligned with said notched area, and means securing said web to said pokethrough device in assembly together.

19. The device of claim 16 further characterized by said U-shaped upright fitting wall being peripherally bounded by upright posts for receiving a jack holder plate in mounted assembly therewith, opposite legs of said U-shaped upright fitting wall being notched providing confronting notched areas through which wiring may be passed through said plate-like fitting and said plate-like base, and linking upright dividers mounted on said plate-like floor fitting having one end secured to one of the legs of said U-shaped upright fitting wall and with said dividers being on opposite sides of said U-shaped upright fitting wall thus expanding said central compartment and dividing said peripheral compartment enabling high density and low density units to be installed in varied arrangements on said device.

20. The device of claim 16 further characterized by said plate-like floor fitting having upright lugs mounted on opposed edges of said plate-like floor fitting in spaced relationship to said U-shaped fitting wall and with said lugs being located in said peripheral compartment said peripheral compartment being generally U-shaped in configuration, said upright lugs providing means for maintaining wires from electrical units when mounted on said device away from opposed edges of said plate-like floor fitting, said peripheral compartment also being U-shaped in configuration surrounding said U-shaped fitting wall.

* * * * *